US009192221B2

(12) United States Patent
Just et al.

(10) Patent No.: US 9,192,221 B2
(45) Date of Patent: Nov. 24, 2015

(54) INSERT FOR A CARRYING STRAP

(75) Inventors: Anatol Rainer Just, Shanghai (CN); Noah Daniel Sussman, Nuremberg (DE)

(73) Assignee: adidas AG, Herzogenaurach (DE)

( * ) Notice: Subject to any disclaimer, the term of this patent is extended or adjusted under 35 U.S.C. 154(b) by 821 days.

(21) Appl. No.: 13/076,093

(22) Filed: Mar. 30, 2011

(65) Prior Publication Data

US 2012/0012628 A1 Jan. 19, 2012

(30) Foreign Application Priority Data

Mar. 30, 2010 (DE) ..... 10 2010 003 481

(51) Int. Cl.
*A45F 3/12* (2006.01)
*A45F 3/04* (2006.01)
*A45C 13/02* (2006.01)

(52) U.S. Cl.
CPC . *A45F 3/04* (2013.01); *A45C 13/02* (2013.01); *A45F 3/047* (2013.01); *A45F 3/12* (2013.01); *A45F 2003/122* (2013.01)

(58) Field of Classification Search
CPC ..... A45C 13/30; A45F 3/14; F41C 33/002
USPC ..... 224/254, 578, 643; 24/300–301; 2/339
See application file for complete search history.

(56) References Cited

U.S. PATENT DOCUMENTS

| | | | | | |
|---|---|---|---|---|---|
| 1,493,684 | A * | 5/1924 | Linder | 24/323 |
| 1,734,371 | A * | 11/1929 | Frost | 2/324 |
| 4,827,578 | A | 5/1989 | Heckerman et al. | |
| 4,976,388 | A | 12/1990 | Coontz | |
| 5,143,266 | A * | 9/1992 | Heckerman et al. | 224/150 |
| 5,695,102 | A * | 12/1997 | Jackson | 224/264 |
| 5,890,640 | A * | 4/1999 | Thompson | 224/630 |
| 6,375,053 | B1 | 4/2002 | Cecchinel | |
| 7,458,135 | B2 * | 12/2008 | Mikesell et al. | 24/300 |
| 7,537,510 | B2 * | 5/2009 | Gransberry | 450/86 |
| 8,132,699 | B2 * | 3/2012 | Hess et al. | 224/264 |
| 8,267,290 | B2 * | 9/2012 | Schlipper | 224/264 |
| 8,366,081 | B2 * | 2/2013 | Staihar | 267/69 |
| 2006/0019577 | A1 * | 1/2006 | Gransberry | 450/86 |
| 2006/0163305 | A1 | 7/2006 | Tong | |
| 2008/0217371 | A1 * | 9/2008 | Wemmer | 224/579 |
| 2009/0026241 | A1 | 1/2009 | Leyendecker | |
| 2010/0288812 | A1 * | 11/2010 | Cross et al. | 224/643 |

FOREIGN PATENT DOCUMENTS

| | | | |
|---|---|---|---|
| DE | 299 10 127 | U1 | 9/1999 |
| DE | 10 2006 007 334 | A1 | 8/2007 |
| WO | WO 94/16595 | | 8/1994 |
| WO | WO 03/007749 | A1 | 1/2003 |

* cited by examiner

*Primary Examiner* — J. Gregory Pickett
*Assistant Examiner* — John Cogill
(74) *Attorney, Agent, or Firm* — Sterne, Kessler, Goldstein & Fox P.L.L.C.

(57) ABSTRACT

The present invention relates to an insert for a carrying strap for carrying objects at the body. In an exemplary embodiment, the insert includes an essentially elastic section and a limitation section, wherein a length of the limitation section limits elongation of the essentially elastic section. The length of the limitation section is adjustable.

23 Claims, 6 Drawing Sheets

INSERT FOR A CARRYING STRAP

BACKGROUND OF THE INVENTION

1. Field of the Invention

The present invention relates to an insert for a carrying strap for carrying objects by persons.

2. Background Art

Carrying objects is made easier when they can be carried by hand using a handle or when they can be carried at the body using a carrying strap.

A carrying strap has the advantage that the weight of the object is distributed over larger areas of the body. The use of two carrying straps, for example with a backpack, makes it possible to distribute the weight symmetrically over the body. In this way, heavy loads can be more easily carried.

Carrying an object can involve vertical movements and accelerations that result in additional vertical forces that act on the body of the carrier of the object. These vertical forces increase when going up a staircase, on uneven ground, or when walking fast, for example. These forces may be sensed as a hitch or an impact on the body.

For cushioning such forces it is known to provide carrying straps with an elastic section that distributes the momentum carried over to the body caused by vertical accelerations over a longer period and therefore results in a smaller force exerted on the body. For example, International Application Publication No. WO 03/007749 A1 describes a backpack with carrying straps that include such an elastic section.

When carrying heavy loads and/or in cases of strong vertical accelerations, however, there is the risk that the elastic section may be elongated too far or may be over-elongated beyond the elasticity of its material. In order to avoid this problem, it is known to limit the elongation of the elastic section, for example by an inelastic strap having ends stitched to the ends of the elastic section, as described in German Patent No. DE 299 10 127. Similar techniques for limiting the elongation of elastic sections are described in U.S. Pat. Nos. 4,827,578 and 4,976,388, and US Patent Application Publication No 2006/0163305. In addition to limitation of the elongation of a carrying strap, International Application Publication No. WO 94/16595 describes an elastic section of a carrying strap that includes several layers of different length, providing graduated cushioning of vertical forces.

Although such a limited cushioning makes it easier to carry loads, the comfort provided is confined to a specific range of vertical forces. In contrast, the forces desired to be cushioned may vary widely. A specific cushioning that is considered comfortable during walking may result, during running, in a substantially greater elongation of the elastic section, due to the stronger vertical forces, that may not be considered comfortable.

What is needed is improved elastic cushioning of a carrying strap so that adjustment to different vertical forces is possible.

SUMMARY OF THE INVENTION

Exemplary embodiments of the present invention include an insert for a carrying strap for carrying objects at the body. In an exemplary embodiment the insert includes an essentially elastic section and a limitation section, wherein a length of the limitation section limits an elongation of the essentially elastic section. The length of the limitation section is adjustable.

A carrying strap including such an insert may be used, for example, in a backpack and permits adjustment of the cushioning of the elastic section to different requirements. For example, due to an additional load in the backpack, the vertical elongations of the insert may become so large that a reduction of the elongations is desired. According to exemplary embodiments of the invention this can be achieved by adjusting the length of the limitation section, which limits elongation of the essentially elastic section. Conversely, when the load is reduced the length of the limitation section may be increased. The same problem may arise during transition from walking to running or during transition from an even ground to an uneven ground with strong vertical forces.

In all these cases, the vertical forces to the carried loads can change substantially, which results in a corresponding change of the elongation of the elastic section. According to exemplary embodiments of the invention this elongation can be limited by the adjustable length of the limitation section. This improves comfort through adaptation to different situations such as described above.

As used herein, a material is considered "essentially elastic" if it returns to its original state after being deformed, except for negligible deviations. Accordingly, a material is considered "essentially inelastic" if common loads and forces do not cause a noticeable elongation of the material. For ease of use, the terms "elastic" and "inelastic" may be used synonymously with "essentially elastic" and "essentially inelastic", respectively.

In an exemplary embodiment, the elastic section includes more than one layer. This enables variation of the elastic properties of the elastic section. In one embodiment, the layers of the elastic section have different elasticities. Additionally, the layers of the elastic section may have different lengths. In this way, an insert may be realized in which the elasticity of the elastic section changes in proportion to the amount by which the elastic section elongates. For example, the force required for elongating the insert may be increased stepwise with the elongation.

In an exemplary embodiment, the length of the limitation section can be adjusted using a ladderlock buckle so that limitation of the elongation of the insert can be adjusted quickly and at any time.

In a further exemplary embodiment the limitation section includes a cord for adjusting the length of the limitation section. Preferably, a change of the length of the cord is greater than the resulting change of the length of the limitation section. The force required for an adjustment is therefore lower, similar to a pulley. Further, this enables a more precise adjustment of limitation of the elongation of the elastic section. Preferably, this is achieved by guiding the cord through inversion points.

In a further exemplary embodiment the cord includes a cord stop or cord lock or slide stop that can be used to adjust the length of the limitation section. Alternatively, the cord includes a hook that can be used for a stepwise adjustment of the length of the limitation section.

In an exemplary embodiment the limitation section includes an essentially inelastic material. The elongation of the elastic section is therefore limited to the length of the limitation section.

Alternatively, the limitation section includes an essentially elastic material. In this case, the elongation of the elastic section is limited to the elongation of the limitation section. This requires that the elasticity of the limitation section is smaller than the elasticity of the elastic section.

Further exemplary embodiments of the invention include a carrying strap having an insert previously described and a backpack or bag with at least one such carrying strap.

A further exemplary embodiment is a backpack or bag that includes an insert, at least one carrying strap and a back section. The insert is arranged between the back section and an end of the at least one carrying strap. Changing the cushioning of this backpack or bag therefore only requires an adjustment of a single insert.

Further exemplary embodiments of the insert for a carrying strap according to the invention are described herein.

BRIEF DESCRIPTION OF THE DRAWINGS/FIGURES

Aspects of the present invention are explained in more detail below with reference to the accompanying figures.

DETAILED DESCRIPTION OF PREFERRED EMBODIMENTS

Exemplary embodiments and variations of the present invention are described herein with reference to an insert for a carrying strap of a carrying bag such as a backpack. In addition, the insert can be used with bags, carry-seats for babies, or other carriers for carrying loads. A carrying strap with the insert can be used for carrying any object, for example a bag for carrying sports devices, such as a ski bag. As explained in the summary of the invention, in the following the term "elastic" is understood as synonymous with "essentially elastic", and the term "inelastic" is understood as synonymous with "essentially inelastic".

Figure 1A:
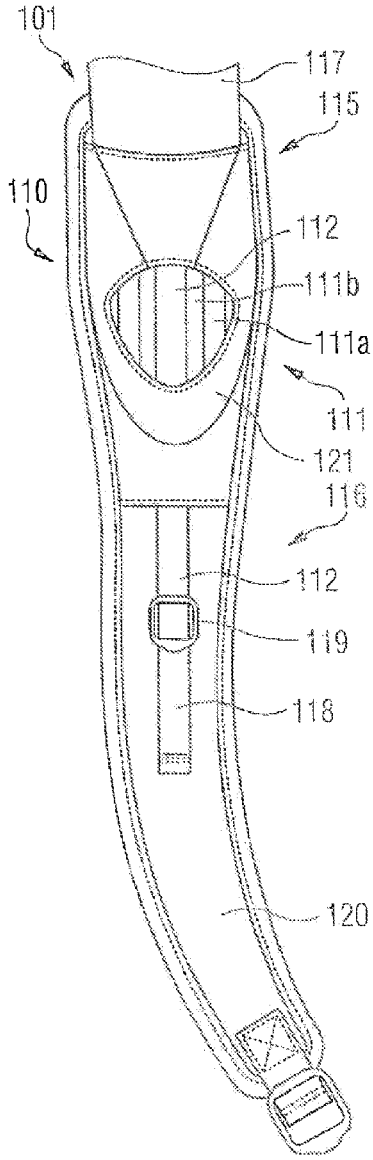
FIG. 1A shows a front view of an insert according to an exemplary embodiment of the present invention.
Figure 1B:
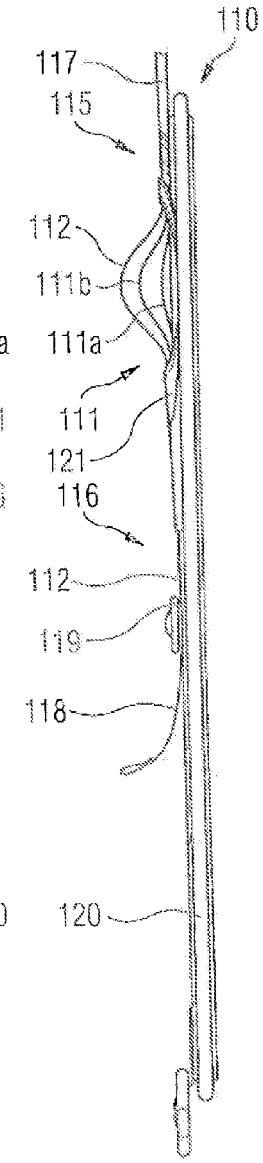
FIG. 1B shows a side view of the insert of FIG. 1A according to an exemplary embodiment of the present invention.
Figure 1C:
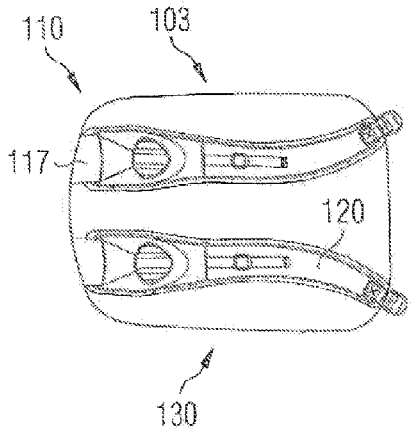
FIG. 1C shows a backpack including the insert of FIG. 1A according to an exemplary embodiment of the present invention.

FIG. 1A shows a front view of an exemplary embodiment of an insert 110. FIG. 1B shows a side view of a left carrying strap 120 including insert 110. FIG. 1C shows a backpack 130 including the carrying strap 120. The backpack 130 is connected to the carrying strap 120 via a connection section 117 and the insert 110. The connection section 117 may, include an inelastic or an elastic material or a combination of both.

The insert 110 is arranged in the upper area 115 of the carrying strap 120 (i.e., at the end of the carrying strap 120, which is connected to the upper side of the backpack 130). One end of the insert 110 is connected to the connection section 117 of the backpack 130, and the other end is connected to the carrying strap 120 in area 116 of carrying strap 120. The insert 110 therefore forms the connection between the carrying strap 120 and the connection section 117 of the backpack 130.

The insert 110 includes an elastic section 111 that provides cushioning of movements of the backpack 130, for example of vertical movements during walking. Such movements cause an elongation of the insert 110 and therefore are not directly transferred to the carrying strap 120 and the body of the carrier of the backpack 130. Rather, the movements are delayed and distributed so that the force exerted on the body is reduced.

The elastic section 111 includes more than one layer, in particular two layers 111*a*, 111*b*. One end of the layers 111*a*, 111*b* is connected to the connection section 117, and the other end of the layers 111*a*, 111*b* is connected to the carrying strap 120 in the area 116. The position of the area 116 may be affected by the length of the elastic section 111. The length of the elastic section 111 may vary. In the embodiment of FIGS. 1A-1C, the length of the elastic section 111 is approximately one third of the length of the carrying strap 120. In other exemplary embodiments, the length of the elastic section 111 may be approximately a half or a quarter of the length of the carrying strap 120. A material of the lower layer 111*a* has a larger elasticity (i.e., a smaller resistance against elongation) than a material of the upper layer 111*b*. As can be seen in the side view of FIG. 1B, the lower layer 111*a* is shorter than the upper layer 111*b*. Therefore, during an elongation of the elastic section 111 the lower layer 111*a* is elongated first, and subsequently the upper layer 111*b* is elongated. The resistance of the elastic section 111 against elongation is therefore increased in a stepwise manner, in proportion to the elongation of the elastic section 111. This principle can be applied to more than two layers of the elastic section 111. The elasticity, width, thickness, and material of layers 111*a*, 111*b* may vary.

The insert 110 further includes a limitation section 112. As can be seen in the side view of FIG. 1B, the limitation section 112 is longer than the lower layer 111*a* and the upper layer 111*b* of the elastic section 111. One end of the limitation section 112 is connected to the connection section 117, and the other end of the limitation section 112 is connected to the carrying strap 120 in area 118. The length of the limitation section 112 corresponds to the distance between the two points at which the limitation section 112 is affixed to the carrying strap 120 and the connection section 117 respectively. In the embodiment of FIGS. 1A-1C, area 118 is arranged approximately in the middle of the carrying strap 120, so that the length of the limitation section 112 is approximately half of the length of the carrying strap 120. The length of the limitation section 112 may vary. For example, the length of the limitation section 112 may be two thirds or one third of the length of the carrying strap 120.

The limitation section 112 is an inelastic material, and therefore the length of the limitation section 112 limits the maximum elongation of the elastic section 111. Alternatively, the limitation section 112 may be an elastic material the elasticity of which is smaller than the elasticities of the layers 111*a*, 111*b*. In this case, the elongation of the limitation section 112 limits the elongation of the elastic section 111. The limitation section 112 may include at one end finger loops for pulling at the limitation section 112 that are not illustrated in FIGS. 1A-1C. For example, limitation section 112 may include finger loops such as the finger loops 612*a* in FIGS. 6A-6C.

In an exemplary embodiment, the width of the lower layer 111*a* is approximately 5 cm, the width of the upper layer 111*b* is approximately 3 cm, and the width of the limitation section 112 is approximately 1.5 cm. These values may vary in other embodiments.

FIG. 1B shows the elastic section 111 in a relaxed state in which the layers 111*a*, 111*b* have minimal length.

A part of the elastic section 111 and a part of the limitation section 112 are covered by a cover 121 that is connected to the carrying strap 120 and that permits sliding of the elastic section 111 and the limitation section 112 under the cover 121. Cover 121 therefore protects the insert 110 and the limitation section 112 and provides guidance for these sections during the movements.

When using the insert 110 in different situations, substantially differing forces may act on the insert 110 causing correspondingly differing elongations. It may therefore be desirable to change the maximum elongation of the insert 110, which is determined by the length of the limitation section 112. This may be enabled by ladderlock buckle 119, which can be used to change the length of the limitation section. Ladderlock buckle 119 is arranged in the section of limitation section 112 that is not covered by cover 121. Use of a ladderlock buckle 119 and its arrangement at the carrying strap 120 facilitates changing the maximum elongation of the elastic section 111, and thereby of the insert 110, rapidly and at any time, for example during a transition from walking to running.

As can be recognized in FIGS. 1A and 1B, the limitation section 112 can be shortened so that it is shorter than or equal to the length of the lower layer 111*a*. In this case, the elastic section 111 cannot elongate any more. In this position the elastic section 111 therefore has no effective elasticity.

Figure 2A:
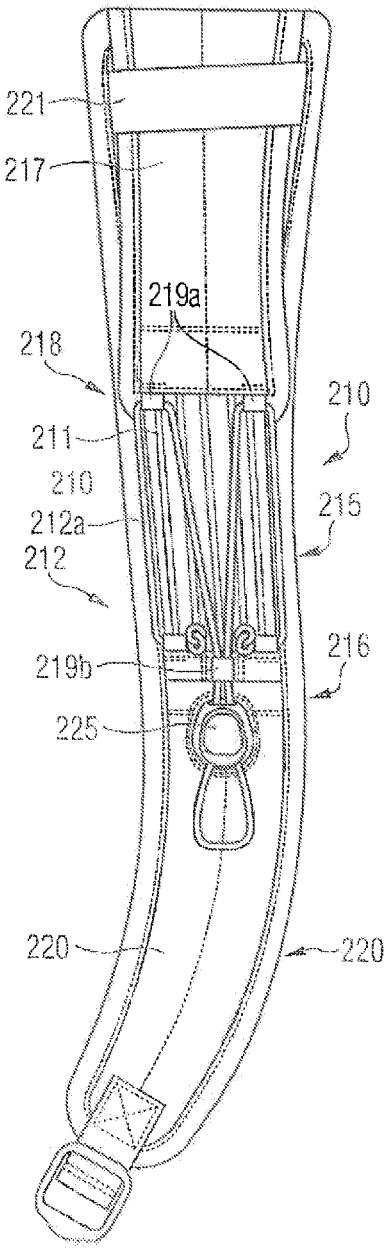
FIG. 2A shows a front view of an insert according to an exemplary embodiment of the present invention.
Figure 2B:
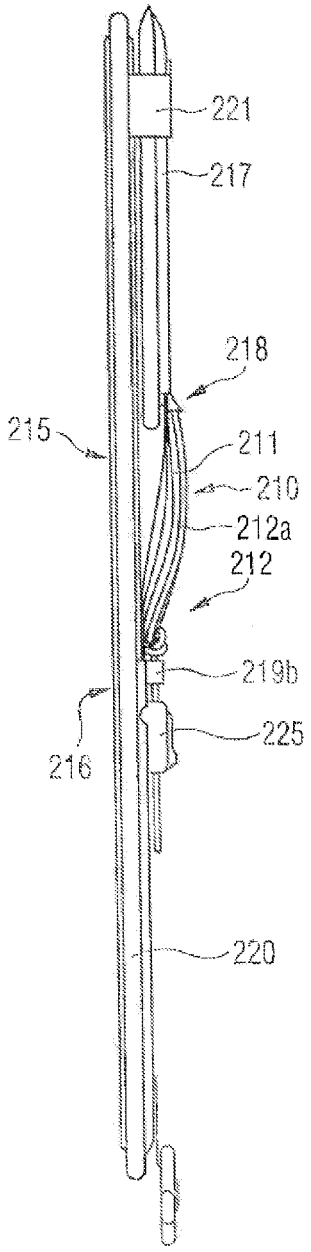
FIG. 2B shows a side view of the insert of FIG. 2A according to an exemplary embodiment of the present invention.
Figure 2C:
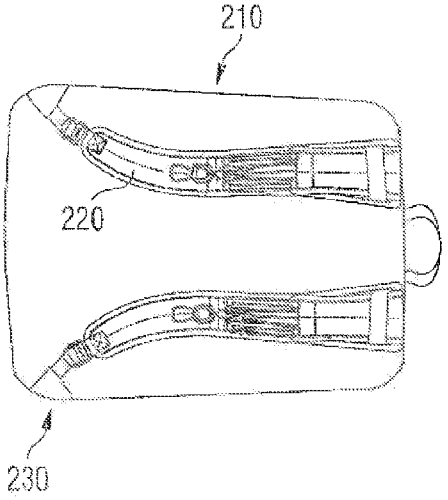
FIG. 2C shows a backpack including the insert of FIG. 2A according to an exemplary embodiment of the present invention.

FIG. 2A shows a front view of an exemplary embodiment of an insert 210. FIG. 2B shows a side view of a left carrying strap 220 including the insert 210. FIG. 2C shows a backpack 230 including the carrying strap 220. The carrying strap 220 is connected to the backpack 230 via the insert 210 and a connection section 217. In this embodiment, the connection section 217 is substantially longer than the connection section 117 in FIGS. 1A-1C. Therefore, in contrast to FIGS. 1A-1C, the insert 210 is arranged in a middle area 215 of the carrying strap 220. Since the connection section 217 overlays carrying strap 220, connection section 217 glides on carrying strap 220 during elongations of the insert 210, rather than on a garment of the carrier of the backpack. This improves comfort during use. During movements of the connection section 117 with respect to carrying strap 220, the connection section 217 is guided by guidance 221, which is connected to the carrying strap 220.

Elastic section 211 of insert 210 includes more than one layer, in particular three layers, which are illustrated in FIGS. 2A-2C. In the embodiment of FIGS. 2A-2C these layers have essentially the same length and the same elasticity. Preferably, elastic section 211 has a width of approximately 5 cm and is an elastic material. One end of elastic section 211 is connected to the connection section 217, and the other end of elastic section 211 is connected to the carrying strap 220 in the area 216. Insert 210 is illustrated in FIGS. 2A-2C in a relaxed state.

Insert 210 further includes a limitation section 212. Limitation section 212 includes a cord 212*a*, preferably an inelastic cord with a diameter of about 3 mm. Alternatively, an elastic cord can be used having elasticity smaller than the elasticity of the elastic section 211. Two ends of the cord 212*a* are fixed to the borders of carrying strap 220 in area 216. They run further through loops 219*a*, which are fixed in area 218 to connection section 217, and further through a single loop 219*b*, which is connected to carrying strap 220 in area 216. Beyond loop 219*b* cord 212*a* is held by slide lock 225. By pulling or releasing cord 212*a* using slide lock 225 the maximum elongation of the insert 210 can be continuously adjusted, and the cord 212*a* can be fixed using the slide lock 225. The slide lock 225 is fixed to the carrying strap 220, for example by sewing. The adjustable length of the limitation section 212, which limits the elongation of the insert 210, is determined by the distance of the cord 212*a* between area 216 and the loops 219*a*, in a tensioned state of the cord 212*a*. The length of the limitation section 212 can be adjusted using cord 212*a*.

Loops 219*a* act as turning points for cord 212*a* so that limitation section 212 becomes a "pulley", Namely, a reduction of the elongation of elastic section 211 by distance S requires that cord 212*a* is shortened by distance 2S. This halves the force needed for reducing the length of cord 212*a*, against the weight of the backpack. Conversely, the weight of the backpack can be used for increasing the elongation of insert 210 when the backpack is carried, since the weight acts in the direction of a larger elongation of elastic section 211.

Figure 3A:
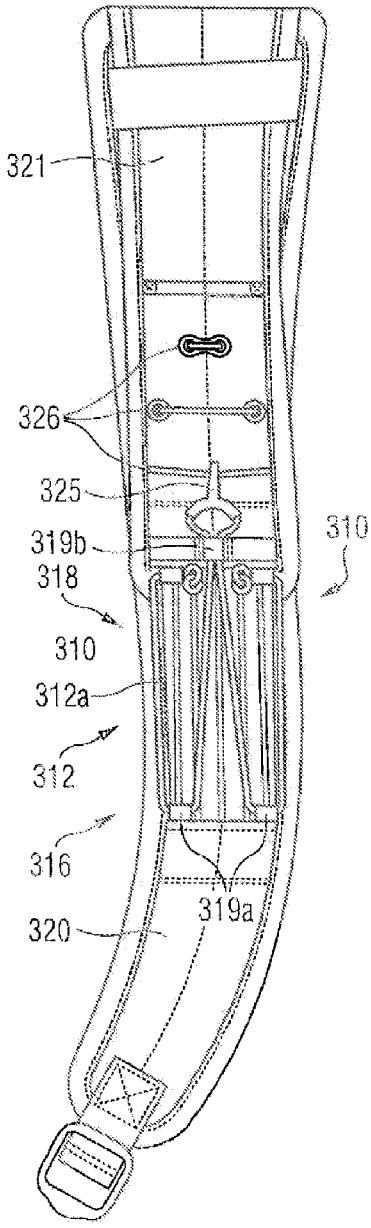
FIG. 3A shows a front view of an insert according to an exemplary embodiment of the present invention.
Figure 3B:
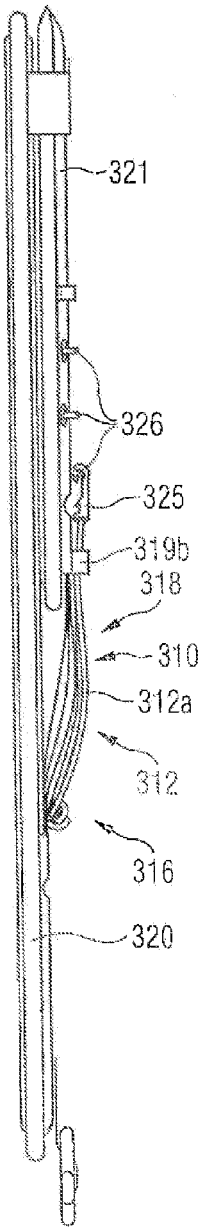
FIG. 3B shows a side view of the insert of FIG. 3A according to an exemplary embodiment of the present invention.
Figure 3C:
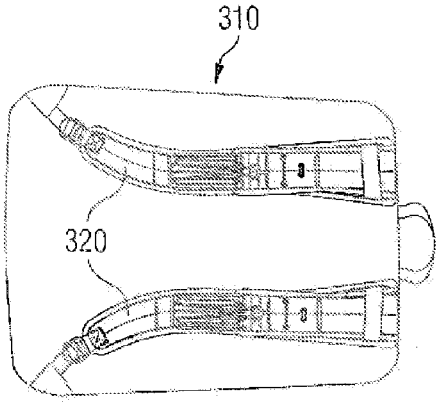
FIG. 3C shows a backpack including the insert of FIG. 3A according to an exemplary embodiment of the present invention.

FIGS. 3A-3C illustrate a variant of the exemplary embodiment of FIGS. 2A-2C. In contrast to FIGS. 2A-2C, the two ends of cord 312*a* of limitation section 312 are connected to connection section 217 in area 318. They run through loops 319*a*, which are fixed to carrying strap 320 in area 316, and further through a single loop 319*b*, which is connected to connection section 317 in area 318. Beyond loop 319*b* cord 312*a* forms a noose which is received by a hook 325. Hook 325 can be hooked into loops 326, which are fixed to carrying strap 320 at different distances from loop 319*b*. This permits a stepwise adjustment of the elongation of insert 310. The adjustable length of limitation section 312 is achieved similarly to that described above with reference to the embodiment of FIGS. 2A-2C.

Figure 4:
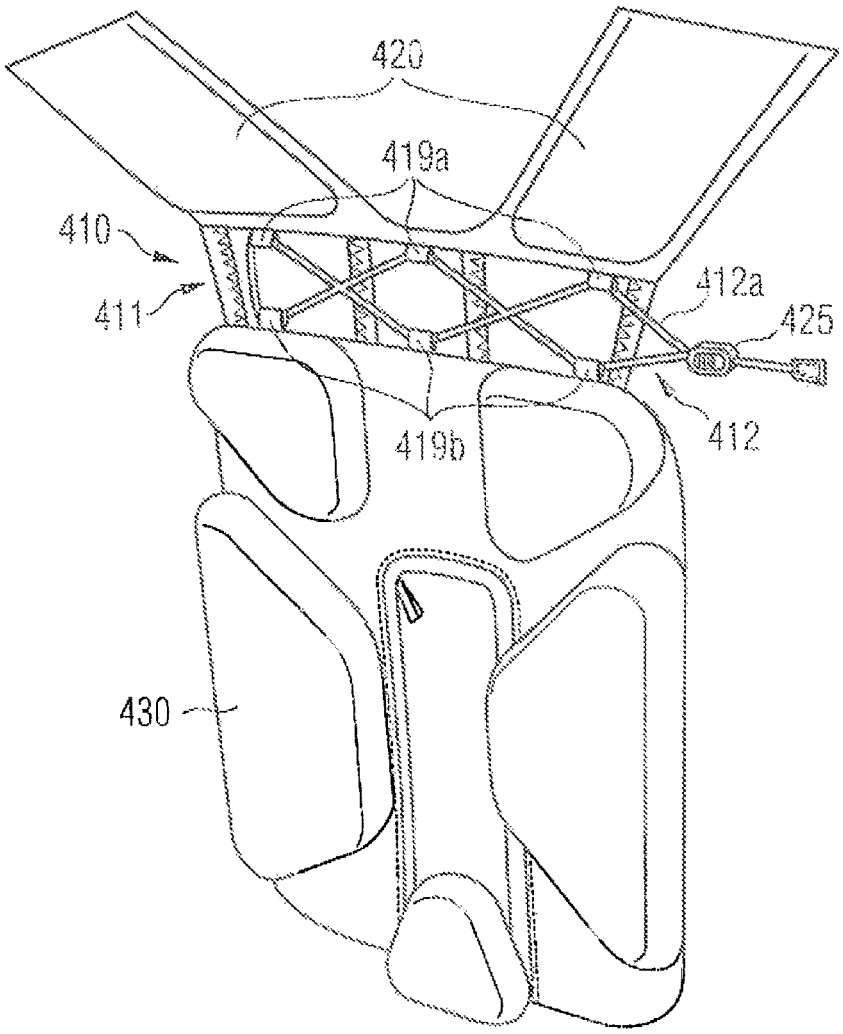
FIG. 4 shows a perspective view of an insert according to an exemplary embodiment of the present invention.

FIG. 4 illustrates an exemplary embodiment of an insert 410 in a perspective view. In this embodiment, a single insert 410 is arranged between a back section 430 of a backpack and the ends of carrying straps 420.

Insert 410 includes an elastic section 411 which extends substantially across the whole width of back section 430. Limitation section 412 includes a cord 412*a* that runs alternatingly between loops 419*a*, which are connected to carrying straps 420, and loops 419*b*, which are connected to back section 430. Both ends of cord 412*a* meet at slide lock 425 on one side of insert 410. By pulling or releasing cord 412*a* the maximum elongation of insert 410 can be reduced or increased. Releasing cord 412*a* can be supported by the weight of the backpack when the backpack is carried. This exemplary embodiment has the advantage that the cushioning for both carrying straps 420 can be adjusted simultaneously using insert 410, instead of by adjusting the carrying straps 420 separately.

The adjustable length of limitation section 412, which limits the elongation of elastic section 411, is determined by the distance between loops 419*a* and loops 419*b*, when cord 412*a* is tensioned.

A limitation section could also be formed by a wire that runs similar to cords 212, 312, 412 between loops and further includes a rotating coil with a turning knob. Such adjustment systems are distributed under the name BOA LATCHING SYSTEM by the company BOA TECHNOLOGIES, for example. Using such a limitation section, the cushioning can be adjusted precisely and simply by turning the turning knob. The advantage of this design is that loose ends of bands or laces may be avoided.

In the embodiments of FIGS. 2A to 4, cord 212*a*, 312*a*, 412*a* of limitation section 212, 312, 412 may be an elastic cord. As an example, cord 212*a*, 312*a*, 412*a* may have a diameter of 3 mm. The resulting elasticity of limitation section 212, 312, 412 should be smaller than the elasticity of the corresponding elastic section 211, 311, 411, in order to limit the elongation of elastic section 211, 311, 411.

Figure 5:
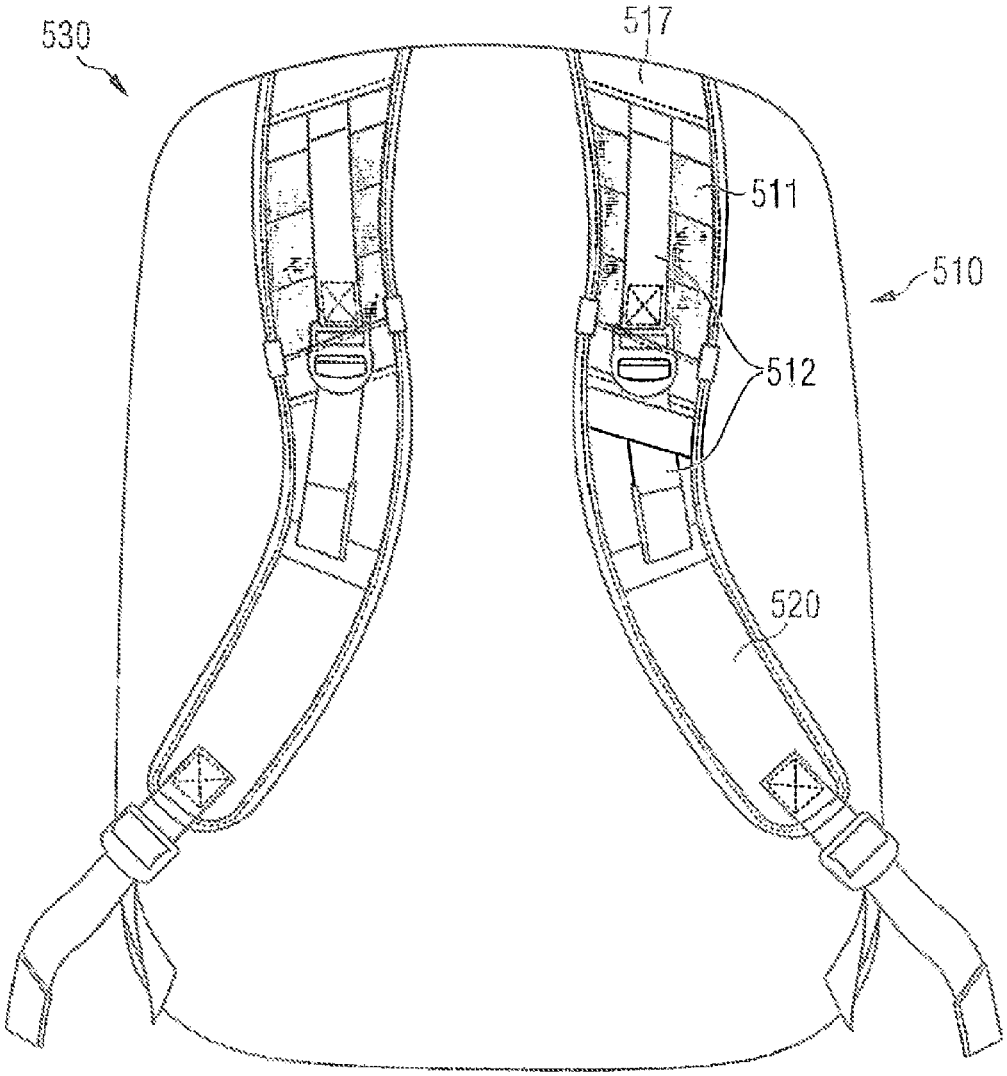
FIG. 5 shows a backpack including inserts according to an exemplary embodiment of the present invention.

In FIG. 5 a backpack 530 with carrying straps 520 is illustrated, in accordance with an exemplary embodiment of the present invention. Backpack 530 is connected to the carrying strap 520 via connection section 517 and the insert 510, and the insert 510 includes an elastic section 511 and a limitation section 512. In contrast to FIGS. 1A-1C, elastic section 511 only includes a single layer. In some embodiments, the elastic section 511 extends over the whole width of carrying strap 520. In other exemplary embodiments the elastic section 511 extends only over a part of the width. In FIG. 5, the width of the elastic section 511 is approximately one quarter of the length of carrying strap 520, and the length of the limitation section 512 is approximately half of the length of carrying strap 520. These length relationships may vary in other embodiments.

Figure 6A:
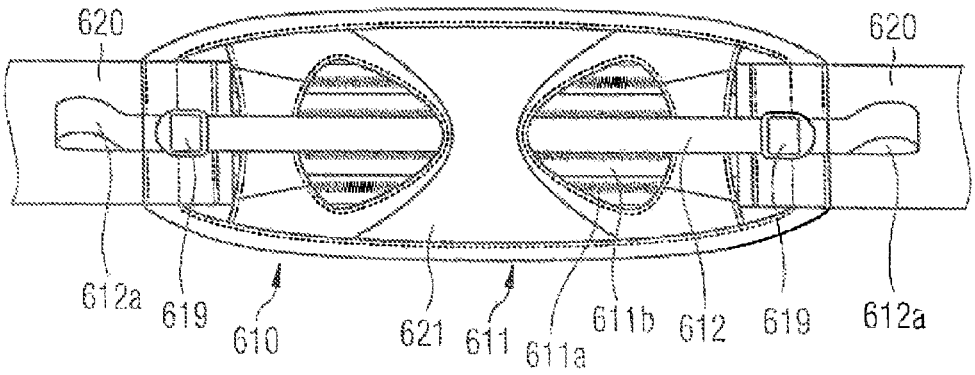
FIG. 6A shows a front view of an insert according to an exemplary embodiment of the present invention.
Figure 6B:
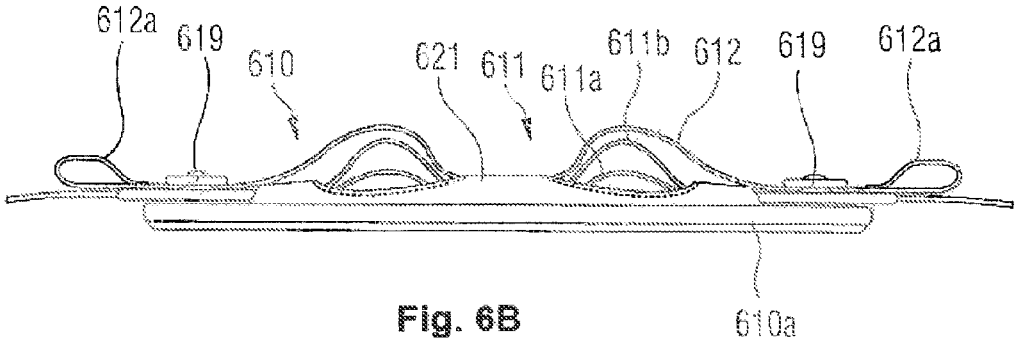
FIG. 6B shows a side view of the insert of FIG. 6A according to an exemplary embodiment of the present invention.
Figure 6C:
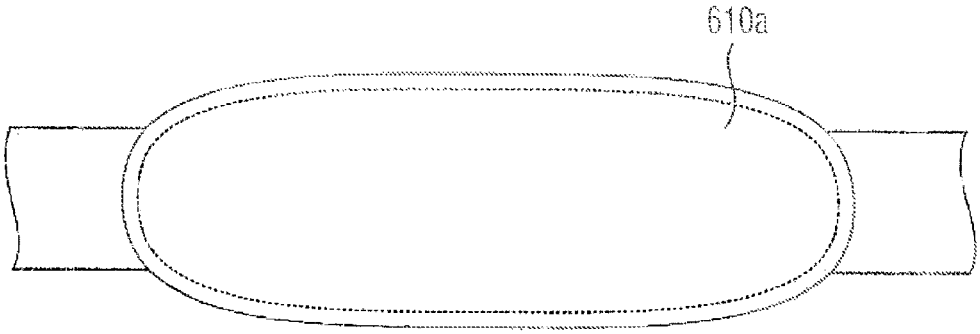
FIG. 6C shows a rear view of the insert of FIG. 6A according to an exemplary embodiment of the present invention.

FIG. 6A shows a front view of an insert 610 according to an exemplary embodiment of the present invention. FIG. 6B shows a side view of the insert 610. FIG. 6C shows a rear view of the insert 610. Insert 610 may be used in carrying strap 620, which may be used, for example, as a shoulder strap for a carrying bag. Insert 610 is arranged between two ends of the carrying strap 620. Insert 610 includes an elastic section 611 and a limitation section 612. The elastic section 611 includes more than one layer, in particular two layers 611*a*, 611*b*.

Limitation section 612 is connected to carrying strap 620 at both ends. In contrast to the exemplary embodiment illustrated in FIGS. 1A-1C, limitation section 612 includes, at both ends, a ladder lock buckle 619 for adjusting the length of limitation section 612, which limits the maximum elongation of elastic section 611, and therefore of insert 610. Limitation section 612 is formed as a band and includes at both ends finger loops 612*a* for pulling.

Further, insert 610 includes, similar to the exemplary embodiment of FIGS. 1A-1C, a cover 621 including two openings located over a part of the elastic section 611 and a part of the limitation section 612. Cover 621 is connected to carrying strap 620 so that sliding of elastic section 611 and limitation section 612 under the cover 621 is possible. Cover 621 therefore protects elastic section 611 and limitation section 612 and provides guidance during their movements. The openings of the insert 610 provide space for an extension of elastic section 611 and limitation section 612 when, for example, the length of the insert 610 is shortened due to a reduced load or a reduced vertical force.

The lower side area 610*a* of the insert 610 is formed as a closed surface, preferably a cushioned surface, so that elongations and contractions of the insert 610 do not chafe the body of the carrier of the carrying strap 620.

What is claimed is:

1. An insert for a carrying strap for carrying objects, the insert comprising:

an elastic section comprising more than one layer coupled together at a first connection and a second connection; and a limitation section overlapping the layers of the elastic section from the first connection to the second connection, wherein a length of the limitation section limits an elongation of the elastic section, and wherein said length of the limitation section is adjustable.

2. The insert of claim 1, wherein the limitation section comprises a cord configured to be used to adjust said length of the limitation section.

3. The insert of claim 2, wherein the cord is configured so that a change of the length of the cord is greater than the resulting change of said length of the limitation section.

4. The insert of claim 2, wherein the cord is guided by at least one inversion point.

5. The insert of claim 2, wherein the cord comprises a slide lock configured to be used to adjust said length of the limitation section.

6. The insert of claim 2, wherein the cord comprises a hook configured to be used to adjust said length of the limitation section in a stepwise manner.

7. The insert of claim 1, wherein each layer has an elasticity different from the elasticities of the other layers.

8. The insert of claim 7, wherein each layer has a length different from the lengths of the other layers between the first connection and the second connection.

9. The insert of claim 1, wherein the limitation section comprises an elastic material.

10. The insert of claim 9, wherein the elastic material of the limitation section is less elastic than material of the elastic section.

11. The insert of claim 1, wherein each layer has a length different from the lengths of the other layers between the first connection and the second connection.

12. The insert of claim 1, wherein the limitation section comprises a band configured to be used to adjust said length of the limitation section.

13. The insert of claim 1, wherein the limitation section comprises a ladderlock buckle configured to be used to adjust said length of the limitation section.

14. The insert of claim 1, wherein the limitation section comprises an inelastic material.

15. The insert of claim 1, wherein a maximum degree of elongation of the elastic section is adjustable by adjustment of said length of the limitation section.

16. A carrying bag, comprising:

at least one carrying strap comprising:

an insert comprising:

an elastic section comprising more than one layer coupled together at a first connection and a second connection; and a limitation section overlapping the layers of the elastic section from the first connection to the second connection, wherein a length of the limitation section limits an elongation of the elastic section, and wherein said length of the limitation section is adjustable.

17. The carrying bag of claim 16, further comprising:

a back section, wherein the insert is arranged between the back section and an end of the at least one carrying strap.

18. The carrying bag of claim 16, wherein a maximum degree of elongation of the elastic section is adjustable by adjustment of said length of the limitation section.

19. A carrying strap, comprising:

an insert comprising:

an elastic section comprising more than one layer coupled together at a first connection and a second connection; and a limitation section overlapping the layers of the elastic section from the first connection to the second connection, wherein a length of the limitation section limits an elongation of the elastic section, and wherein said length of the limitation section is adjustable.

20. The carrying strap of claim 19, wherein a maximum degree of elongation of the elastic section is adjustable by adjustment of said length of the limitation section.

21. A carrying strap, comprising:

a first strap section;

a second strap section overlaying the first strap section;

an insert connecting the first strap section to the second strap section, wherein the insert comprises:

an elastic section comprising more than one layer coupled at a first end to the first strap section, and coupled at a second end to the second strap section, wherein the overlaying portions of the first strap section and the second strap section slide relative to each other upon elongation of the elastic section;

an inelastic limitation section overlaying the layers of the elastic section and coupled to the first strap section and the second strap section, wherein the distance that the first strap section and the second strap section slide relative to each other is limited by a length of the limitation section, wherein said length of the limitation section is adjustable.

22. The carrying strap of claim 21, wherein the first strap section and the second strap section are only connected by the insert.

23. The carrying strap of claim 21, wherein the first strap section and the second strap section are in contact where the second strap section overlays the first strap section.

* * * * *